US008496397B2

(12) United States Patent
Nickas

(10) Patent No.: US 8,496,397 B2
(45) Date of Patent: Jul. 30, 2013

(54) PRECAST CONCRETE SLABS AND RELATED SYSTEMS, METHODS OF MANUFACTURE AND INSTALLATION

(75) Inventor: William N. Nickas, Tallahassee, FL (US)

(73) Assignee: Folded Slab, LLC, Tallahassee, FL (US)

( * ) Notice: Subject to any disclaimer, the term of this patent is extended or adjusted under 35 U.S.C. 154(b) by 0 days.

(21) Appl. No.: 13/597,725

(22) Filed: Aug. 29, 2012

(65) Prior Publication Data

US 2013/0101350 A1 Apr. 25, 2013

Related U.S. Application Data

(60) Provisional application No. 61/548,973, filed on Oct. 19, 2011.

(51) Int. Cl.
*E01C 5/00* (2006.01)

(52) U.S. Cl.
USPC ..... 404/41; 404/34; 14/73

(58) Field of Classification Search
USPC ..... 404/34, 35, 41; 14/73
See application file for complete search history.

(56) References Cited

U.S. PATENT DOCUMENTS

| | | | | | |
|---|---|---|---|---|---|
| 77,208 | A * | 4/1868 | Parson | 404/34 |
| 247,421 | A * | 9/1881 | Schillinger | 404/34 |
| 888,530 | A * | 5/1908 | Pugh | 52/311.2 |
| 1,557,165 | A * | 10/1925 | Hooper | 404/40 |
| 1,660,459 | A * | 2/1928 | Thomson | 404/41 |
| 2,018,711 | A * | 10/1935 | Elmendorf | 52/396.1 |
| 2,025,815 | A * | 12/1935 | Horridge | 404/41 |
| 2,266,178 | A * | 12/1941 | Dubois | 404/35 |
| 3,090,162 | A * | 5/1963 | Baroni | 52/80.2 |
| 4,503,644 | A * | 3/1985 | Coutu, Sr. | 52/13 |
| 4,681,481 | A * | 7/1987 | Kapusta | 404/34 |
| 4,925,338 | A * | 5/1990 | Kapusta | 404/41 |
| 5,140,789 | A * | 8/1992 | De Gooyer | 52/71 |
| 5,966,883 | A * | 10/1999 | Krusec et al. | 52/302.1 |
| 6,058,659 | A * | 5/2000 | Astrom | 52/34 |
| 6,105,324 | A * | 8/2000 | Krusec et al. | 52/302.1 |
| 6,155,015 | A * | 12/2000 | Kirby | 52/302.1 |
| 6,415,570 | B1 * | 7/2002 | Wentz | 52/302.1 |

(Continued)

OTHER PUBLICATIONS

Paul Mack, P.E.,FPCI, Gregory Force, P.E., FPCI, Charles Magnesio, Kip Bryan, P.E., State-of-the-Art Paper, PCI Journal, The Practice of Warping Double Tees, Feb. 2003, pp. 32-49.

(Continued)

*Primary Examiner* — Gary Hartmann
(74) *Attorney, Agent, or Firm* — McClure, Qualey & Rodack, LLP

(57) ABSTRACT

Precast concrete slabs, methods of manufacture and installation are provided. In this regard, a representative precast concrete slab includes: a first portion, substantially triangular in shape and exhibiting first, second and third sides, the first and second sides being positioned along an exterior of the slab and residing in a first plane; and a second portion, substantially triangular in shape and exhibiting first, second and third sides, the first and second sides of the second portion being positioned along the exterior of the slab and residing in a second plane, the second plane being non-parallel with respect to the first plane; the third side of the first portion and the third side of the second portion being positioned adjacent to each other and forming a transition between the first plane and the second plane.

18 Claims, 4 Drawing Sheets

U.S. PATENT DOCUMENTS

| | | | | |
|---|---|---|---|---|
| 6,467,224 | B1 * | 10/2002 | Bertolini | 52/177 |
| 6,607,329 | B2 | 8/2003 | Smith | |
| 6,663,315 | B2 | 12/2003 | Smith | |
| 6,709,192 | B2 | 3/2004 | Smith | |
| 6,899,489 | B2 | 5/2005 | Smith | |
| 6,966,161 | B2 * | 11/2005 | Palsson et al. | 52/589.1 |
| 7,004,674 | B2 * | 2/2006 | Smith | 404/73 |
| 7,591,605 | B2 * | 9/2009 | Jonasz et al. | 404/15 |
| 7,594,777 | B2 * | 9/2009 | Chiu | 404/35 |
| 8,288,652 | B2 * | 10/2012 | Lubanski | 404/35 |
| 2008/0118307 | A1 * | 5/2008 | Weiss | 404/41 |
| 2008/0267703 | A1 * | 10/2008 | Adam | 404/41 |

OTHER PUBLICATIONS

Thomas J. D'Arcy, P.E., Gerald E Goettsche, P.E., Mickey A. Pickell, P.E., PCI Journal, The Florida Suncoast Dome, Feb. 1990, pp. 76-94.

Thomas J. D'Arcy, Design and Construction Best Practices, Yielding Good Parking Structure Performance, PCI Journal, Apr. 2008, pp. 1-8.

Gregory Banks, Laura N. Lowes, PH.D., John F. Stanton, PHD., P.E., PCI Journal, Analysis and Design for End Effects in Twisted Double Tees, Jun. 2005, pp. 40-59.

Reported by Joint PCI-PTI Committee on Segmental Construction, PCI Journal, Recommended Practice for Precast Post-Tensioned Segmental Construction, Jan. 1982, pp. 1-50.

* cited by examiner

PRECAST CONCRETE SLABS AND RELATED SYSTEMS, METHODS OF MANUFACTURE AND INSTALLATION

CROSS REFERENCE TO RELATED APPLICATION

This application is a utility application that claims priority to co-pending U.S. Provisional Patent Application entitled, "Triangulated or Folded Slabs, Methods or Manufacture and Installation", having Ser. No. 61/548,973, filed Oct. 19, 2011, which is entirely incorporated herein by reference.

TECHNICAL FIELD

The disclosure involves precast concrete slabs for roadway and/or bridge installations.

SUMMARY

Precast concrete slabs and related systems, methods of manufacture and installation are provided. In this regard, an embodiment of a precast concrete slab comprises: a first portion, substantially triangular in shape and exhibiting first, second and third sides, the first and second sides being positioned along an exterior of the slab and residing in a first plane; and a second portion, substantially triangular in shape and exhibiting first, second and third sides, the first and second sides of the second portion being positioned along the exterior of the slab and residing in a second plane, the second plane being non-parallel with respect to the first plane; the third side of the first portion and the third side of the second portion being positioned adjacent to each other and forming a transition between the first plane and the second plane.

An embodiment of a method for using precast concrete slabs comprises: providing a first slab having a first portion and a second portion, the first portion being substantially triangular in shape and residing in a first plane, the second portion being substantially triangular in shape and residing in a second plane non-parallel with respect to the first plane; providing a second slab having a first portion and a second portion, the first portion of the second slab being substantially triangular in shape and residing in a third plane, the second portion of the second slab being substantially triangular in shape and residing in a fourth plane non-parallel with respect to the third plane; and orienting the second slab such that the first portion of the second slab is adjacent the second portion of the first slab.

Other systems, methods, features, and advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Precast concrete slabs and related systems, methods of manufacture and installation are provided. In some embodiments, a system involves the use of precast concrete slabs for making highway bridge decks or pavements, for example, in a tangent or curved application. As described in more detail below, such a slab may be formed of two portions that are substantially triangular in shape, with each of the portions residing in a different plane. The portions may be joined at a transition along a common third side of the portions to form a slab with a folded configuration. In plan, a slab may be a rectangle, parallelogram, or a trapezoid. Side edges may be cast as straight lines or horizontally curved. Additionally, slabs may be strengthened with one or a combination of techniques such as mild reinforcement, pre-tensioned strands, or post-tensioned systems made with ferrous and/or non-ferrous materials.

Figure 1A:
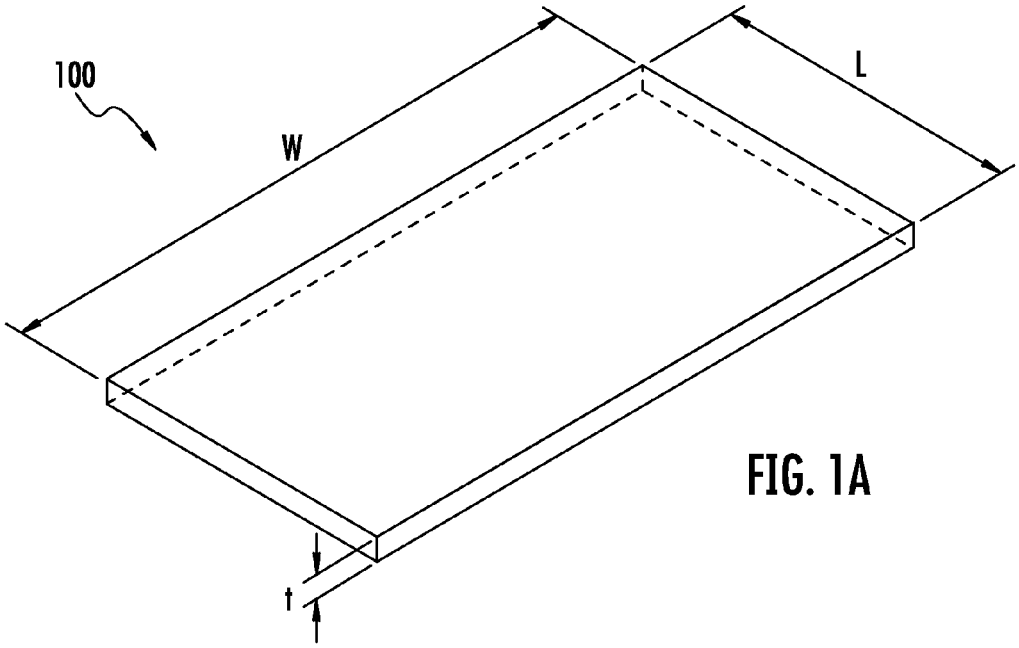
FIGS. 1A and 1B are schematic diagrams of representative embodiments of a slab.
Figure 1B:
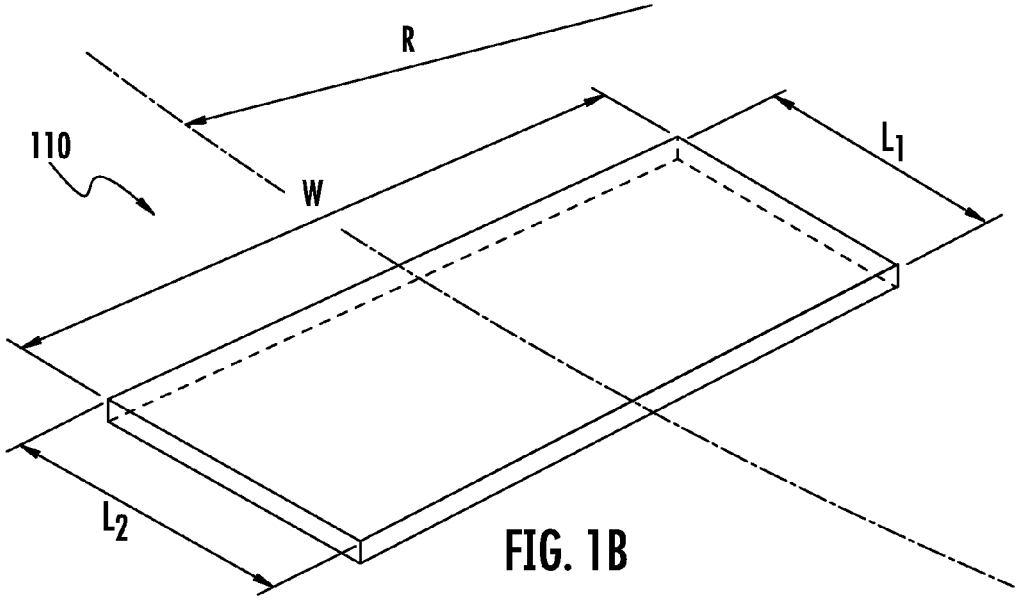

FIGS. 1A and 1B are schematic diagrams of representative embodiments of a slab. As shown in FIG. 1A, slab 100 is generally rectangular and exhibits a length (L), a width (W) and thickness (t). In some embodiments, the thickness is between approximately 8 and approximately 13 inches. A typical length of a slab is between approximately 10 and approximately 12 feet, and a typical width is between approximately 6 feet and approximately 12 feet, although various other dimensions may be used.

As shown in FIG. 1B, slab 110 is configured for use in a curved roadway application. Notably, typical highway curves have a radius (R) of 600 feet or more. By varying the lengths of the sides $L_1$ and $L_2$, precast slabs may traverse a horizontal curve with an appropriate number of slabs arranged in an end to end relationship.

Additionally, highway geometry often requires super elevation. In this regard, an embodiment of a slab may be used to transition to a cross slope. This can be accomplished in a flat, level section of highway or longitudinal grade. Notably, when arranged as short cords the slabs may create a horizontal curved or tangent alignment.

Figure 2A:
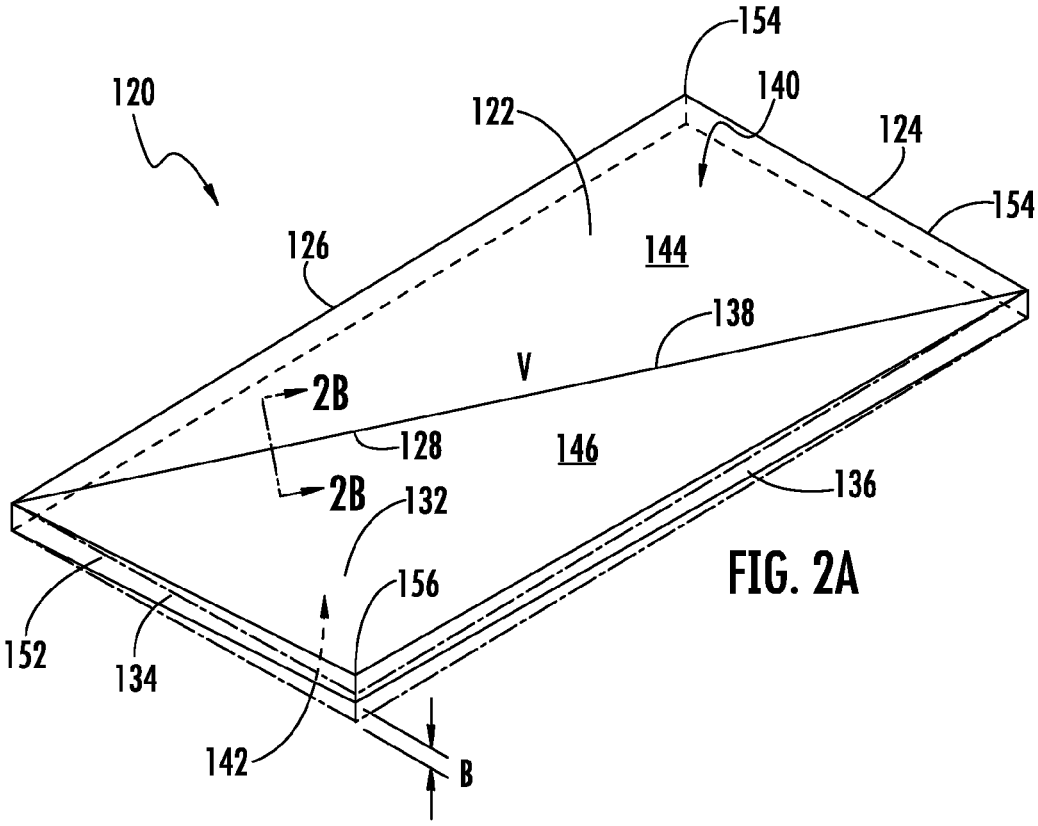
FIG. 2A is a schematic diagram of a representative embodiment of a slab.

FIG. 2A is a schematic diagram of another representative embodiment of a slab. As shown in FIG. 2, slab 120 includes portions 122, 132, in which each is substantially triangular in shape. Portion 122 includes sides 124, 126 and 128, and portion 132 includes sides 134, 136 and 138. Note that sides 128 and 138 are positioned adjacent to each other (in some embodiments, sides 128, 138 are coextensive, such as when cast into the same slab).

Slab 120 exhibits an upper or road surface side 140, and an underside 142. Road surface side 140 includes two flat surfaces 144, 146, each of which is associated with one of the portions 122, 132. Note that portions 122 and 132 (specifically, flat surfaces 144, 146) reside in different planes that intersect at a transition bounded by sides 128, 138. In this embodiment, the transition spans the width and the length of the slab to define a valley (V) oriented along the diagonal of the slab.

Edges 152, 154 forming the lengthwise sides of the slab are normal to the respective flat surfaces, 144, 146.

In this embodiment, flat surface 144 defines an apex 154 located at the intersection of sides 124 and 126. Similarly, flat surface 146 defines an apex 156 located at the intersection of sides 134 and 136. In this embodiment, apex 156 is displaced from the plane in which portion 144 resides by a distance (B) of between approximately 0.25% and approximately 4.0% of the length of the slab. By way of two examples: Case 1, in a slab with a length of twelve feet and a width of twenty four feet, a typical displacement (B) may be 0.72 inches (up or down deflection); Case 2, in a slab thirty-six feet in length and twelve feet wide, a typical displacement may be 2.16 inches. Therefore, displacement at the apex may be lifted or lowered a distance of ¼ to 4 inches in a slab.

Figure 2B:
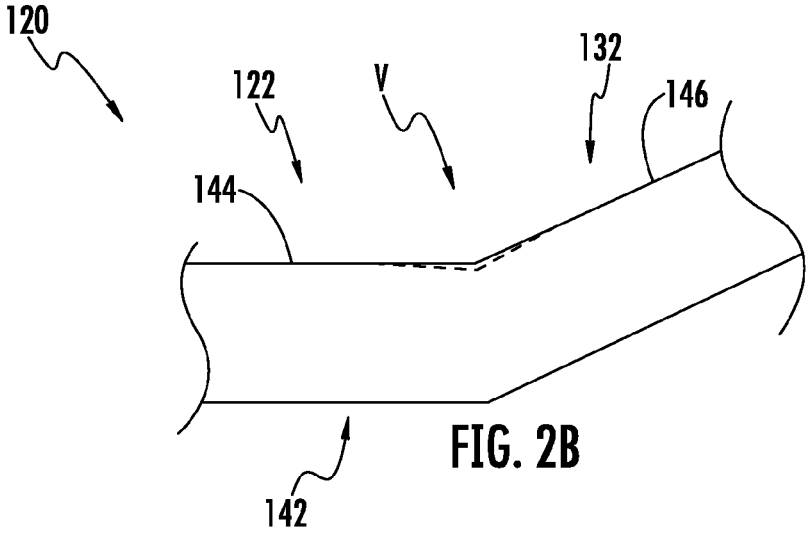
FIG. 2B is a schematic, cross-sectional view of the embodiment of FIG. 2A as viewed along section line 2A-2A.

As shown in FIG. 2B, the valley (V) located between portions 122, 132 may be eased (shown in dashed lines). In some embodiments, this may be a treatment created by formed top cast and/or a post cast treatment created by grinding, for example.

Figure 3:
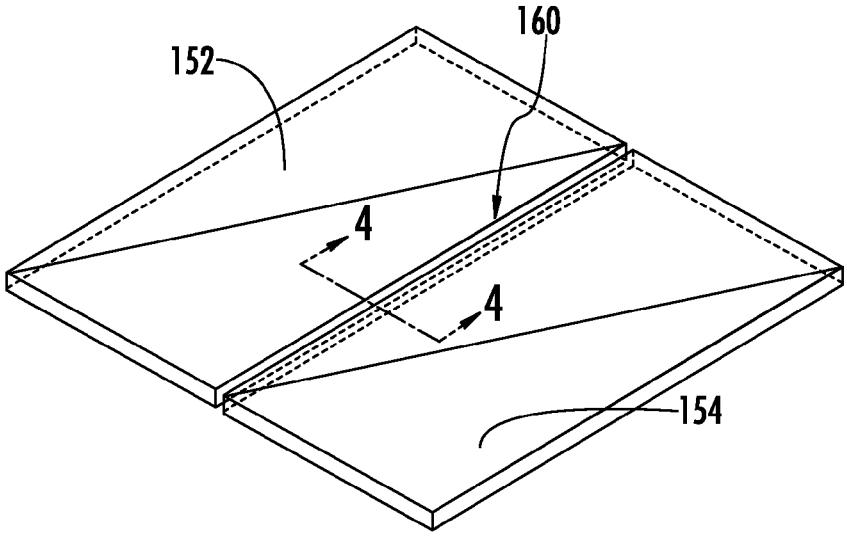
FIG. 3 is a schematic diagram of a representative embodiment of joined slabs.
Figure 4A:
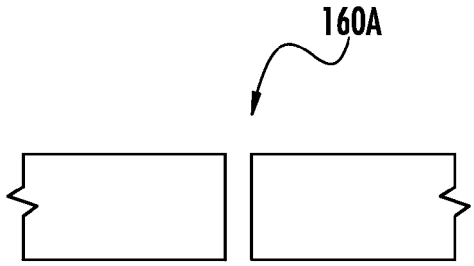
FIGS. 4A-4C are schematic, cross-sectional views of the embodiment of FIG. 3, showing alternative joint details.
Figure 4B:
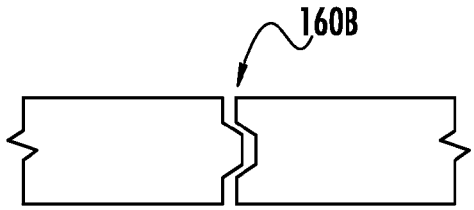
Figure 4C:
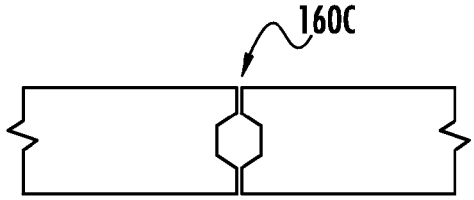

In embodiments in which multiple slabs are used in abutting relationship (such as slabs 152, 154 of FIG. 3), ahead and rear joints may be used. Notably, the joints may be provided in various configurations. In this regard, FIGS. 4A-4C depict alternative examples of joint configurations that may be used for a joint, such as joint 160 formed between slabs 152 and 154. For instance, the joints may be straight (FIG. 4A, joint 160A), male-female (FIG. 4B, joint 160B) or female-female requiring grout fill (FIG. 4C, joint 160C), for example.

The slab may be prestressed by post-tensioning in one or both directions. Pretensioning may be used in the transverse of width (W) direction. Steel or nonmetallic reinforcement is used to control stresses in the longitudinal (L) direction (as defined in the first diagram) of the pavement until the optional post-tensioning is applied.

Segmental bridge construction traditionally utilizes discreet cords with an angle deviation at each intersection or joint to create a longitudinal grade and transverse angle change. Transverse slope changes are also created in the same way by rotating about an axis. (See *Recommended Practice for Precast Post-Tensioned Segmental Construction*, Journal Prestressed Concrete Institute (1982), which is incorporated herein by reference).

Figure 5:
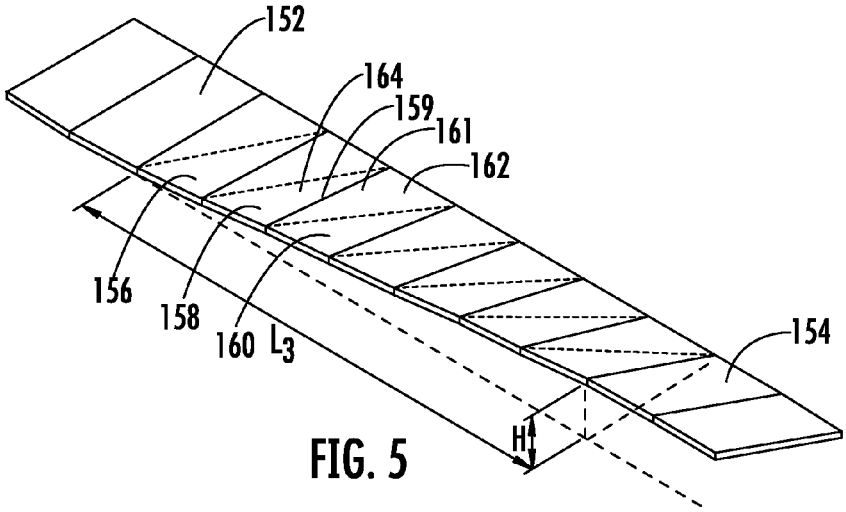
FIG. 5 is a schematic diagram of a representative embodiment of joined slabs.

When assembling multiple slabs together, the cross slope may be transitioned as shown in FIG. 5. As shown, system 200 includes multiple slabs over a length $L_3$ creating a total transition of cross slope shown as H. Specifically, the system includes multiple planar slabs (e.g., slabs 152 and 154) and multiple folded slabs (e.g., 156, 158, 160), with the slabs being placed in an end-to-end configuration.

Typical geometric criteria have a maximum transition rate of 1:200 feet for higher speed facilities. If a slab is used in a roadway application, the subgrade and base may be trenched to a constant depth matching the vertical and horizontal grade control as may be required in a highway construction project. If the slabs are used in a bridge application, leveling bolts maybe used to achieve the desired profile above the beams.

In this regard, an embodiment of a method for using precast concrete slabs involves providing multiple folded slabs and orienting the slabs so that the slabs are aligned end-to-end, and potentially forming abutting relationships between adjacent slabs. Notably, a trailing edge of a next slab is aligned with a leading edge of the previous slab. For instance, trailing edge 161 of slab 160 is aligned with leading edge 159 of slab 158. As such, the trailing portion 162 of slab 160 is oriented in the same plane as the leading portion 164 of slab 158, thus creating a ridge. This configuration creates undulations along the centerlines of the slabs and a straight line down each edge of the assembly.

Figure 6:
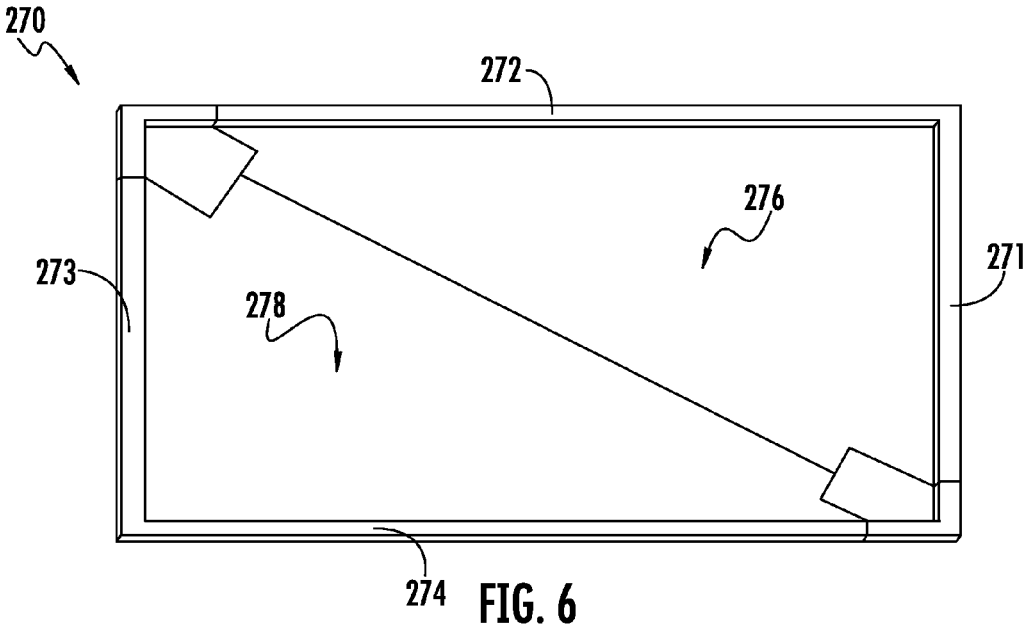
FIG. 6 is a schematic, bottom view of a representative embodiment of a slab.

When a folded slab is installed in a roadway (non-bridge application), the underside of the slab may include multiple (e.g., five) planes. In this regard, an embodiment of a slab 270 that exhibits multiple planes is depicted in FIG. 6. As shown in FIG. 6, slab 270 incorporates edge curbs 271, 272, 273 and 274, leading (triangular) recess 276, a trailing (triangular) recess 278.

Once the slabs are installed and connected, the area under the slab may be grouted through ports cast into the slab. The undulations within the top surface of the slabs (deviations from the theoretical smooth grade) may be removed by grinding and grooving. This is a typical construction process wherein a sacrificial thickness (e.g., ½ inch) is cast into the panel to facilitate a smooth top riding surface.

It should be emphasized that the above-described embodiments are merely examples of possible implementations. Many variations and modifications may be made to the above-described embodiments without departing from the principles of the present disclosure.

The invention claimed is:

1. A method for using precast concrete slabs in a curved roadway application to support vehicular traffic, the method comprising:

providing a first slab having a first portion and a second portion, the first portion being substantially triangular in shape and residing in a first plane, the second portion being substantially triangular in shape and residing in a second plane non-parallel with respect to the first plane;

providing a second slab having a first portion and a second portion, the first portion of the second slab being substantially triangular in shape and residing in a third plane, the second portion of the second slab being substantially triangular in shape and residing in a fourth plane non-parallel with respect to the third plane;

positioning the first slab to form a first section of the curved roadway; and orienting the second slab such that the first portion of the second slab is adjacent the second portion of the first slab, wherein, in orienting the second slab, the first portion of the second slab is aligned with the second plane, in which the second portion of the first slab resides.

2. The method of claim 1, wherein the first slab comprises:

the first portion, substantially triangular in shape and exhibiting first, second and third sides, the first and second sides being positioned along an exterior of the first slab and residing in the first plane; and the second portion, substantially triangular in shape and exhibiting first, second and third sides, the first and second sides of the second portion being positioned along the exterior of the first slab and residing in the second plane;

the third side of the first portion and the third side of the second portion being positioned adjacent to each other and forming a transition between the first plane and the second plane.

3. The method of claim 2, wherein:

the respective first sides of the first and second portions correspond to the width of the first slab;

the respective second sides of the first and second portions correspond to the length of the first slab; and the transition spans the width and the length of the slab to define a diagonal of the first slab.

4. The method of claim 3, wherein:

the first and second sides of the first portion intersect at a first apex; and the first apex is positioned out of the second plane by a distance of between approximately 0.25% and approximately 4.0% of the length of the slab.

5. The method of claim 4, wherein the first apex is positioned out of the second plane by a distance of between approximately 0.50% and approximately 3.0% of the length of the first slab.

6. The method of claim 3, wherein:

the first and second sides of the first portion intersect at a first apex; and the first apex is positioned out of the second plane by a distance of between approximately 0.25% and approximately 2.0% of the width of the first slab.

7. The method of claim 6, wherein the first apex is positioned out of the second plane by a distance of between approximately 0.5% and approximately 1.5% of the width of the first slab.

8. The method of claim 2, wherein the transition is an eased transition.

9. The method of claim 2, wherein a perimeter edge of the first slab is normal to an upper surface of the first slab.

10. The method of claim 2, wherein the third side of the first portion and the third side of the second portion are both linear such that the transition is linear.

11. The method of claim 2, wherein:

the first portion has a road surface side and an opposing underside; and the underside has a first lip extending along the first side and a second lip extending along the second side, the first lip and the second lip protruding downwardly to define a first recess on the underside of the first portion.

12. The method of claim 11, wherein:

the second portion has a road surface side and an opposing underside; and the underside of the second portion has a first lip extending along the first side of the second portion and a second lip extending along the second side of the second portion, the first lip of the second portion and the second lip of the second portion protruding downwardly to define a first recess on the underside of the second portion.

13. The method of claim 12, wherein the first recess of the first portion and the first recess of the second portion form a contiguous recess along the underside of the first slab.

14. The method of claim 1, further comprising pre-stressing the first slab and the second slab.

15. The method of claim 1, wherein providing the first slab and providing the second slab further comprises installing the slabs to form a highway bridge deck.

16. The method of claim 1, further comprising:

providing a third slab, the third slab being a flat slab; and orienting the first slab such that the first portion of the first slab is adjacent the third slab.

17. The method of claim 1, further comprising:

providing a third slab, the third slab being a flat slab; and orienting the third slab such that the third slab is adjacent the second portion of the second slab.

18. The method of claim 1, further comprising abrading material from a transition formed between the first portion and the second portion of the first slab such that the transition is an eased transition.

* * * * *